US008054233B2

(12) United States Patent
Holt et al.

(10) Patent No.: US 8,054,233 B2
(45) Date of Patent: Nov. 8, 2011

(54) ROLLER BASED ANTENNA POSITIONER

(75) Inventors: Wayne Holt, Dacula, GA (US); E. Mitchell Blalock, Atlanta, GA (US); Christopher E. Griffin, Duluth, GA (US)

(73) Assignee: ViaSat, Inc., Carlsbad, CA (US)

( * ) Notice: Subject to any disclaimer, the term of this patent is extended or adjusted under 35 U.S.C. 154(b) by 547 days.

(21) Appl. No.: 12/205,645

(22) Filed: Sep. 5, 2008

(65) Prior Publication Data

US 2009/0058745 A1 Mar. 5, 2009

Related U.S. Application Data

(60) Provisional application No. 60/970,186, filed on Sep. 5, 2007.

(51) Int. Cl.
*H01Q 3/00* (2006.01)
*H01Q 3/06* (2006.01)

(52) U.S. Cl. ..... 343/763; 343/757; 343/761; 343/765; 343/766

(58) Field of Classification Search ..... 343/757, 343/759, 761, 763, 765, 766, 878, 882
See application file for complete search history.

(56) References Cited

U.S. PATENT DOCUMENTS 2,786,361 A 3/1957 Langley
3,313,502 A * 4/1967 Suliteanu ..... 248/349.1
3,486,053 A 12/1969 Richards
3,713,164 A * 1/1973 Foury ..... 343/766
4,282,529 A 8/1981 Speicher
4,467,726 A * 8/1984 Aldous et al. ..... 104/246
4,819,002 A * 4/1989 Reboullet ..... 343/765
4,827,269 A * 5/1989 Shestag et al. ..... 343/766
5,119,105 A * 6/1992 Ngai et al. ..... 343/703
6,188,300 B1 2/2001 Rodeffer
6,380,904 B1 * 4/2002 Ogawa ..... 343/754
6,542,129 B1 * 4/2003 Bien et al. ..... 343/766
6,608,596 B2 * 8/2003 Bien et al. ..... 343/705
6,914,578 B1 7/2005 Menahem
7,109,937 B2 * 9/2006 Iluz et al. ..... 343/757
7,663,565 B2 * 2/2010 Son et al. ..... 343/765

OTHER PUBLICATIONS

PCT International Search Report and Written Opinion mailed Nov. 13, 2008, International Application No. PCT/US2008/075478, 18 pages.

* cited by examiner

*Primary Examiner* — Douglas W Owens
*Assistant Examiner* — Chuc Tran
(74) *Attorney, Agent, or Firm* — Kilpatrick Townsend & Stockton LLP

(57) ABSTRACT

According to the invention, a system for positioning an antenna is disclosed. The system may include an antenna, a first substantially circular track, a base, and a first plurality of rollers. The first substantially circular track may be coupled with the antenna. Each of the first plurality of rollers may be coupled with the base. Each of the first plurality of rollers may be in contact with the first substantially circular track. Each of the first plurality of rollers may rotate when the first substantially circular track rotates.

15 Claims, 12 Drawing Sheets

ROLLER BASED ANTENNA POSITIONER

CROSS-REFERENCE TO RELATED APPLICATIONS

This application claims priority to Provisional U.S. Patent Application No. 60/970,186 filed Sep. 5, 2007, entitled "Roller Based Antenna Positioner," the entire disclosure of which is hereby incorporated by reference, for all purposes, as if fully set forth herein.

BACKGROUND OF THE INVENTION

This invention relates generally to antennas. More specifically the invention relates to antenna mounting and positioning systems and methods.

Typical antenna mounting and movement systems rely on turntable bearings, slew rings, shafts, and/or axles to support the loads imparted by antennas. These loads include both the resting weight of the antennas, as well as any wind loading, either due to actual air movement, or movement of the antenna through the air.

Because typical mounting and movement systems have to both support loads as well as provide movement functions, failure of any one of the two functions may impact the other. Additionally, because the functions are not separate, more precise movement and mounting functions may not be possible.

The systems and methods of the present invention provide solutions to these and other problems.

BRIEF DESCRIPTION OF THE INVENTION

In one embodiment, a system for positioning an antenna is provided. The system may include an antenna, a first substantially circular track, a base, and a first plurality of rollers. The first substantially circular track may be coupled with the antenna. Each of the first plurality of rollers may be coupled with the base. Each of the first plurality of rollers may be in contact with the first substantially circular track. Each of the first plurality of rollers may rotate when the first substantially circular track rotates.

In another embodiment, a method for positioning an antenna is provided. The method may include providing an antenna coupled with a first substantially circular track. The method may also include providing a first plurality of rollers. The method may further mating the first substantially circular track with the first plurality of rollers such that a first axis of rotation is defined for the antenna. The method may additionally include rotating the first substantially circular track such that the antenna rotates about the first axis of rotation.

BRIEF DESCRIPTION OF THE DRAWINGS

The present invention is described in conjunction with the appended figures.

Figure 1:
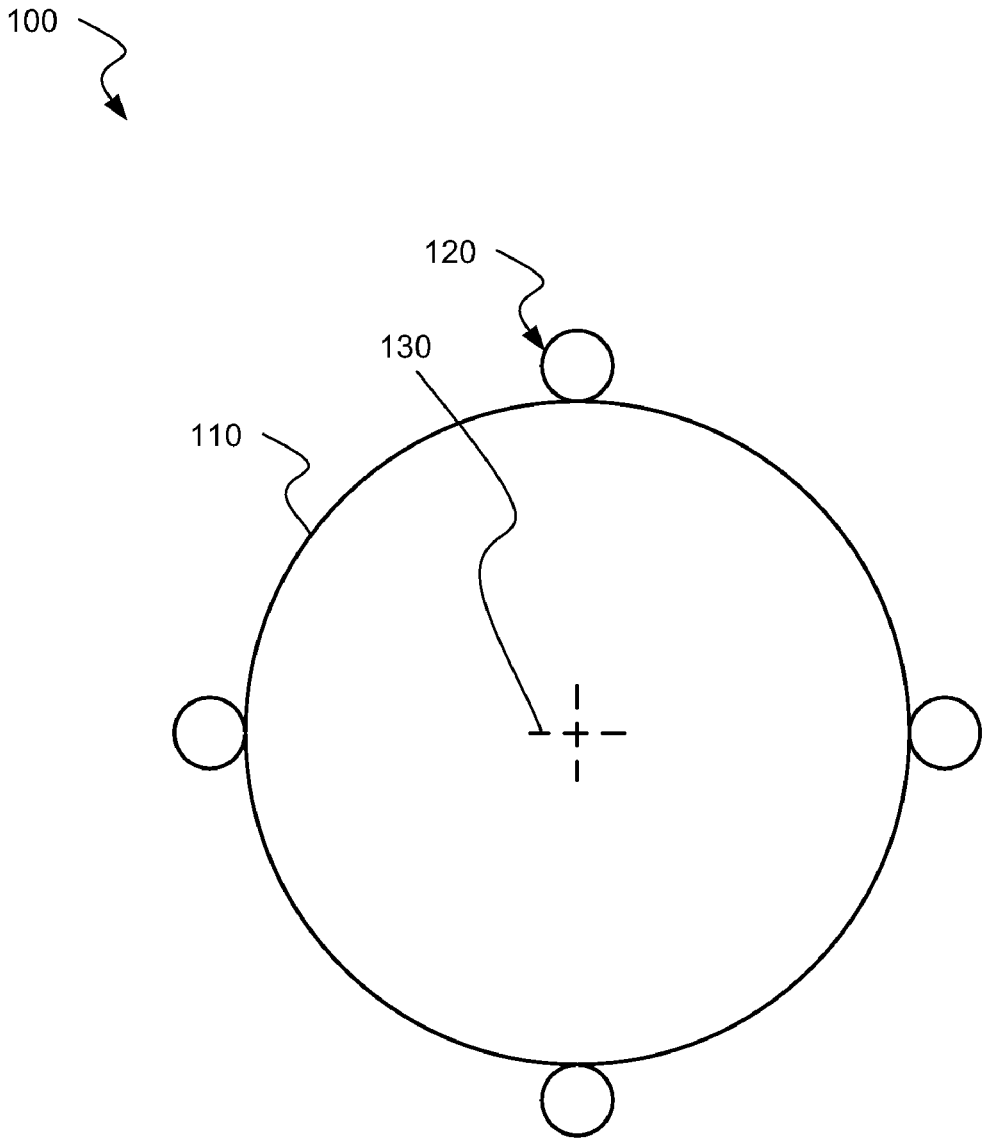
FIG. 1 is a plan schematic view of a track with a plurality of rollers.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

In one embodiment of the invention, a system for positioning an antenna is provided. The system may include an antenna, a first substantially circular track, a base, and a first plurality of rollers.

In some embodiments, the antenna may include a parabolic antenna. In other embodiments, other objects and/or devices may be provided in place of the antenna. Merely by way of example, other possible objects and/or devices may include weapons systems, including mounted firearms, lasers and/or sonic systems; sports equipment such as ball throwers; lighting devices; optical systems or components such as lenses and mirrors; and/or robotic arms.

The first substantially circular track may be coupled with the antenna. The circular track may be comprised of a material that provides an appropriate interface with the rollers. In some embodiments, this material may be metal, possibly steel, aluminum, or an alloy. The interface may be configured to provide the proper amount of friction between the circular track and the rollers such that the antenna resists movement unless positively rotated by a controlled rotational movement subsystem. The circular track may form a complete circle in some embodiments, or only a portion of circle in other embodiments.

Each of the first plurality of rollers may be coupled with the base. The rollers may be coupled such that they mate with the circular track and allow the track to rotate relative to the base. In other embodiments, the track may remain stationary relative to the base, and the object coupled with the rollers may rotate. In some embodiments, the rollers may be constructed from a polymer, possibly, for example, cast or extruded nylon 12. The roller may be mounted on a shaft or stud about which the roller rotates. The shaft or stud may, in some embodiments, be made from stainless steel or other resilient material. In some embodiments, bearings and/or bushing may interface the roller with the shaft or stud.

Each of the first plurality of rollers may be in contact with the first substantially circular track and may rotate when the first substantially circular track rotates. The interface between the roller and the track can be in any number of configurations.

In one configuration, the circular track and the rollers may have a cross-sectional perimeter that is at least partially semi-circular. In some of these configurations, the radius of the semi-circular portion of the perimeter of one of the track or the rollers may be greater than the other. In other configurations, the radius of the semi-circular portion of the perimeter of the track and the rollers may be the same. In different embodiments, either the track or roller cross sectional perimeters may be concave or convex, with the mated component being vice-versa.

In other configurations, the circular track and the rollers may have a cross-sectional perimeter that is at least partially v-shaped. In different embodiments, either the track or roller cross sectional perimeters may be concave or convex, with the mated component being vice-versa.

In other configurations, one of the circular track and the rollers may have a cross-sectional perimeter that is at least partially v-shaped, with the mated component having a cross-sectional perimeter that is at least partially semi-circular.

In some embodiments, rotation of the first substantially circular track may at least approximate, if not equate to, an azimuth rotation of the antenna. In some embodiments, an additional second substantially circular track may also be coupled with the antenna, along with a second plurality of rollers coupled with the base. This second set of track/rollers may allow for rotation that at least approximates, if not equates to, an elevation rotation of the antenna.

In some embodiments, an additional third substantially circular track may also be coupled with the antenna, along with a third plurality of rollers coupled with the base. This third set of track/rollers may allow for rotation that at least approximates, if not equates to, a polarity rotation of the antenna.

In some embodiments, the system for positioning an antenna may also include one or more rotational subsystems configured to rotate the antenna. In various embodiments, each individual rotational subsystem, or some subset of the rotational subsystems, may be configured to provide rotational movement in one of the azimuth, elevation, or polarity axes. In some embodiments the rotational subsystem may include a gear and pinion system. In these or other embodiments, the rotational subsystem may also include a powered roller, able to rotate the track directly. In some embodiments, the rotational subsystem may include a dual shaft motor and/or dual shaft gearbox.

In another embodiment of the invention, a method for positioning an antenna is provided. The method may include providing an antenna coupled with a first substantially circular track. The method may also include providing a first plurality of rollers. The method may further mating the first substantially circular track with the first plurality of rollers such that a first axis of rotation is defined for the antenna. The method may additionally include rotating the first substantially circular track such that the antenna rotates about the first axis of rotation.

In some embodiments of the invention, the antenna may be further coupled with a second substantially circular track, and the method may also include providing a second plurality of rollers and mating the second substantially circular track with the second plurality of rollers such that a second axis of rotation is defined for the antenna. The method may further include rotating the second substantially circular track such that the antenna rotates about the second axis of rotation.

In some embodiments of the invention, the antenna may be further coupled with a third substantially circular track, and the method may also include providing a third plurality of rollers and mating the third substantially circular track with the third plurality of rollers such that a third axis of rotation is defined for the antenna. The method may further include rotating the third substantially circular track such that the antenna rotates about the third axis of rotation.

In some embodiments, the method may also include supporting all of the weight of the antenna with the first plurality of rollers. In these or other embodiments, the method may also include supporting all external loading on the antenna with the first plurality of rollers.

Turning now to FIG. 1, a plan schematic view 100 of a track 110 with a plurality of rollers 120 is shown. In other embodiments, plurality of rollers 120 could be located on the interior, rather than the exterior of track 110 (as shown on FIG. 1). In some embodiments, plurality of rollers 120 could be on both the exterior and interior of track 110. The placement of rollers 120 creates an axis of rotation 130 of track 110. Note that in other embodiments, track 110 may remain stationary, and rollers 120 may rotate about axis 130.

Figure 2:
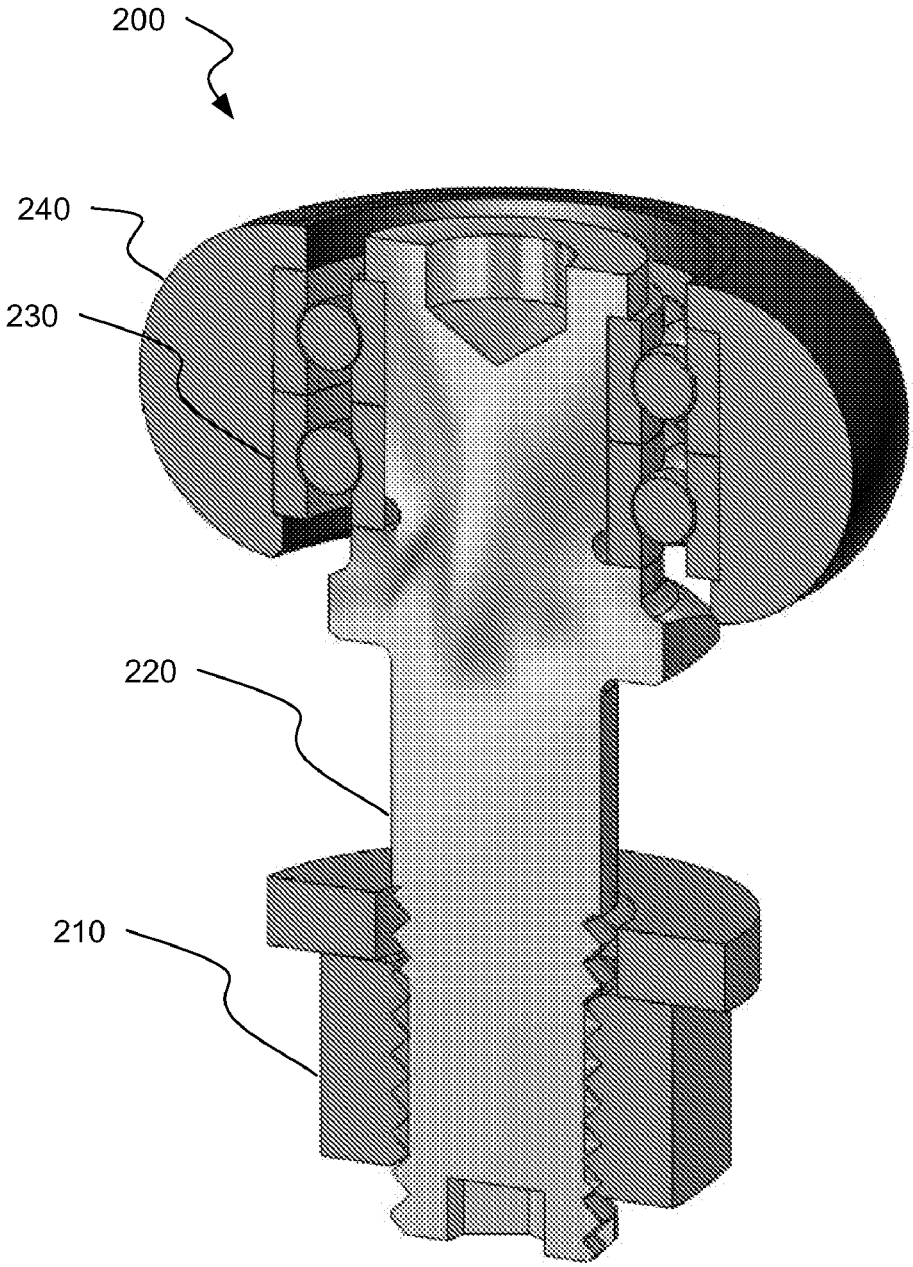
FIG. 2 is an axonometric cut-away view of a roller assembly.

FIG. 2 shows an axonometric cut-away view of a roller assembly 200. Assembly 200 includes an attachment point 210, a post or stud 220, a bearing 230, and a roller 240. Post or stud 220 may be threaded for coupling to attachment point 210, thereby rendering maintenance and replacement easier.

Figure 3:
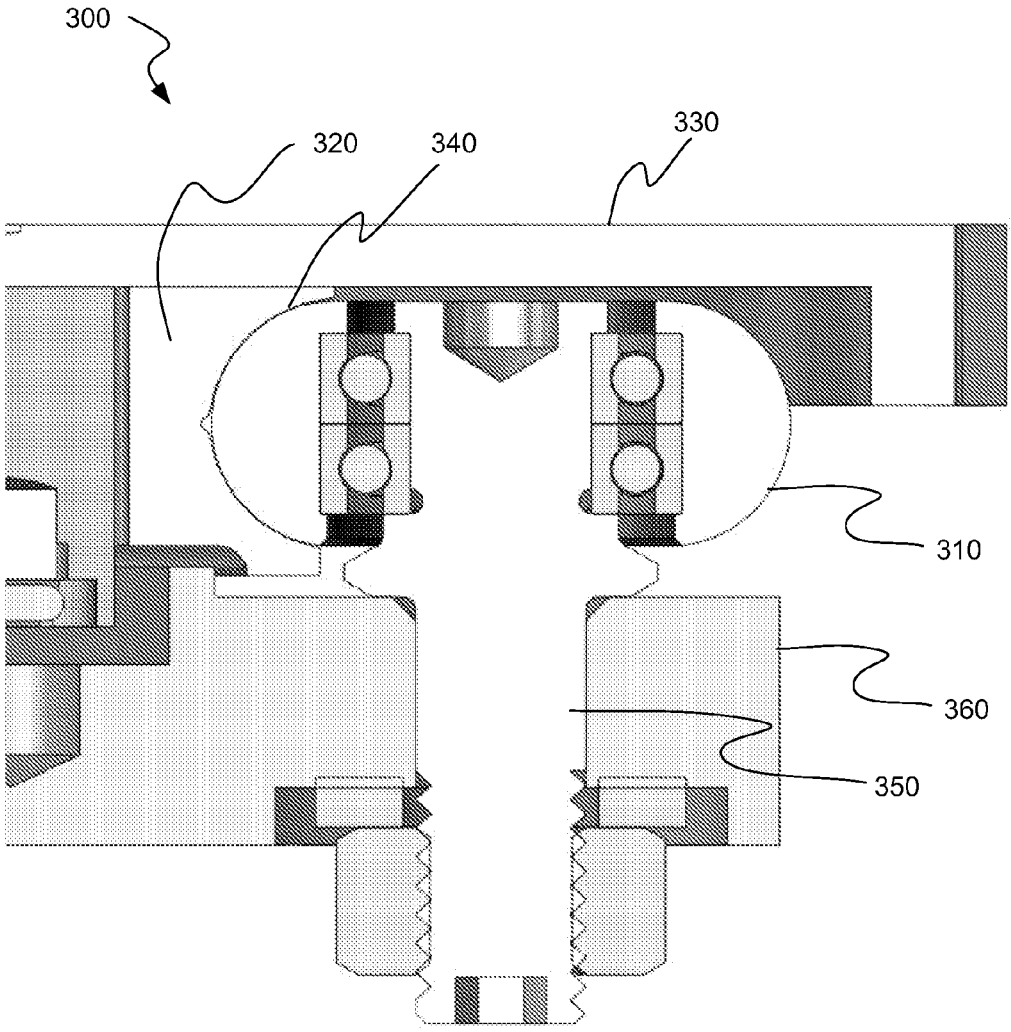
FIG. 3 is a side cut-away view of a roller mating with a track on an antenna system.

FIG. 3 shows a side cut-away view 300 of a roller 310 mating with a track 320 on an antenna system. The antenna system would mount to plate 330, which is coupled with track 320. As track 320 rotates against roller 310, the mating surface 340 between track 320 and roller 310 causes roller 310 to rotate about post or stud 350. Roller 310 may have an axis which is stationary relative to base 360.

Figure 4A:
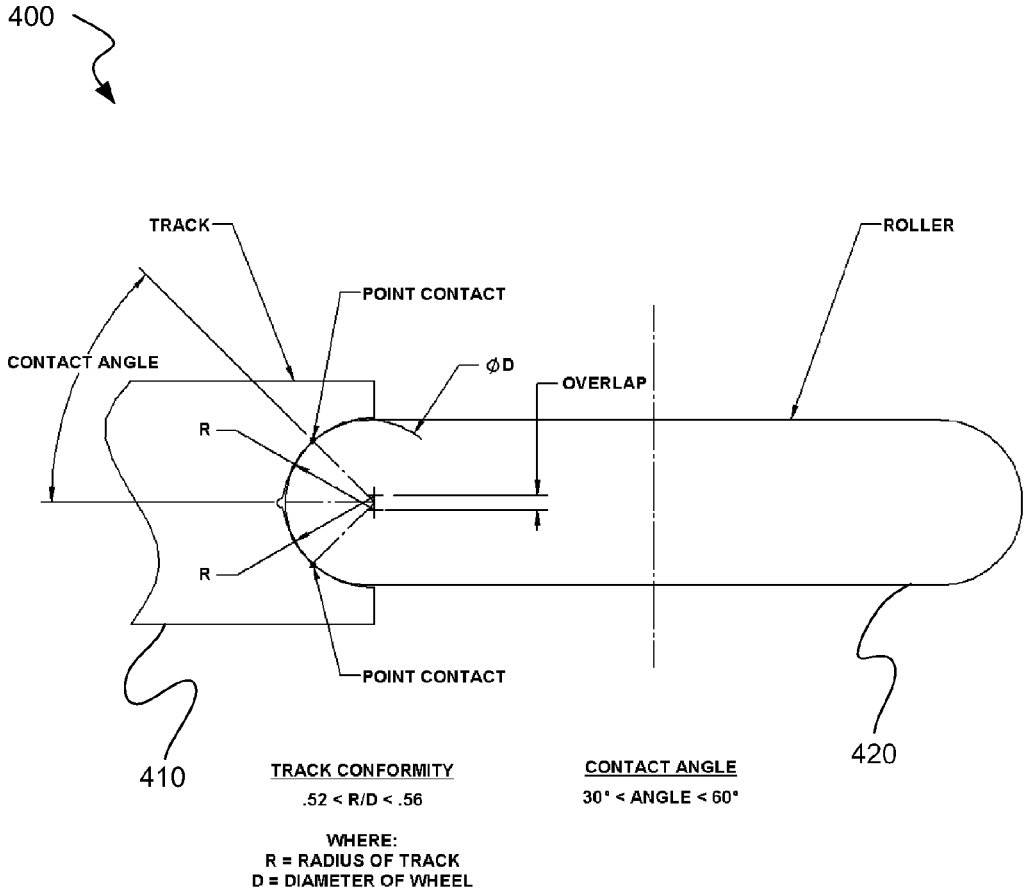
FIG. 4A is a side cut-away view of the mating between a track and a roller in one configuration.

FIG. 4A shows a side cut-away view 400 of the mating between a track 410 and a roller 420 in one configuration. In this configuration, a Gothic arch interface with two points of contact between track 410 and roller 420 is provided.

Figure 4B:
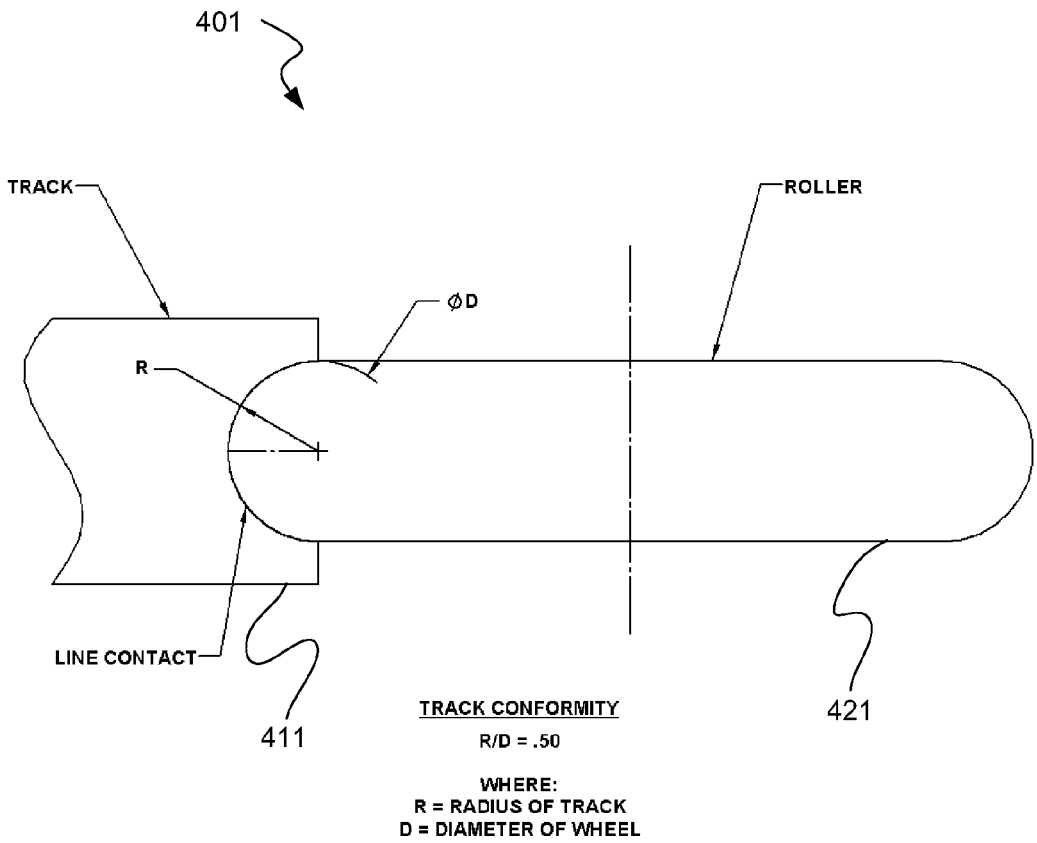
FIG. 4B is a side cut-away view of the mating between a track and a roller in a second possible configuration.

FIG. 4B shows a side cut-away view 401 of the mating between a track 411 and a roller 421 in a second possible configuration. In this configuration, a matching radius interface with a continuous line contact between track 411 and roller 421 is provided.

Figure 4C:
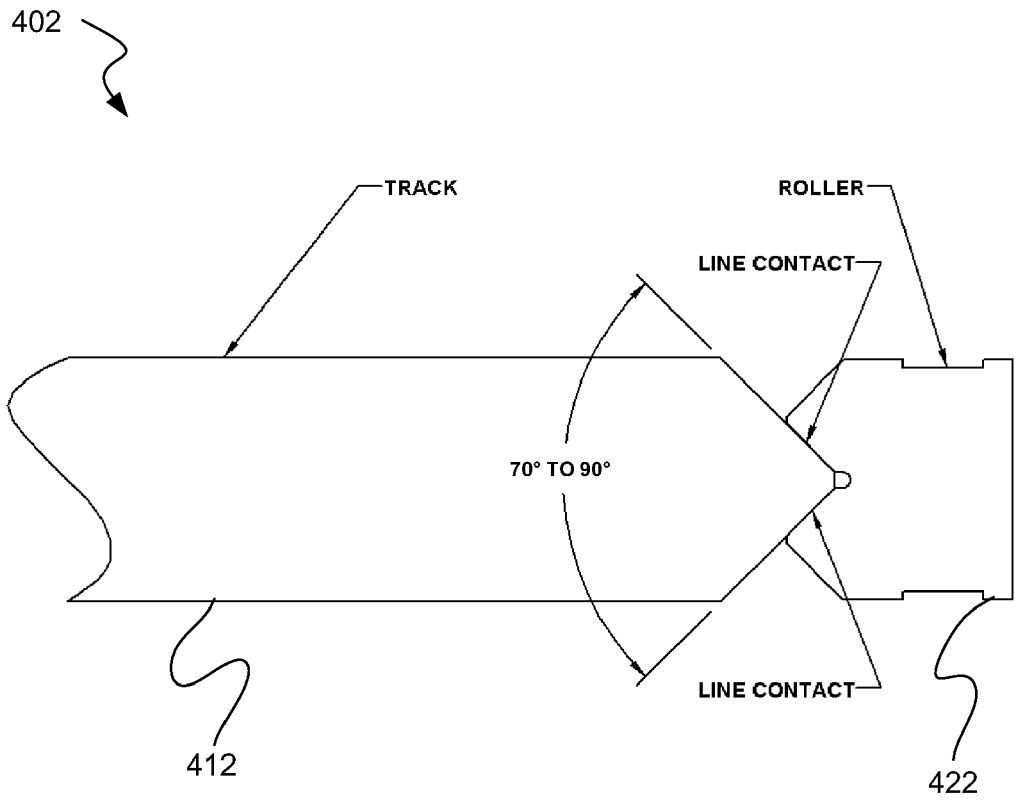
FIG. 4C is a side cut-away view of the mating between a track and a roller in a third possible configuration.

FIG. 4C shows a side cut-away view 402of the mating between a track 412 and a roller 422 in a third possible configuration. In this configuration, a V-groove interface with two continuous line contacts between track 412 and roller 422 is provided.

Figure 4D:
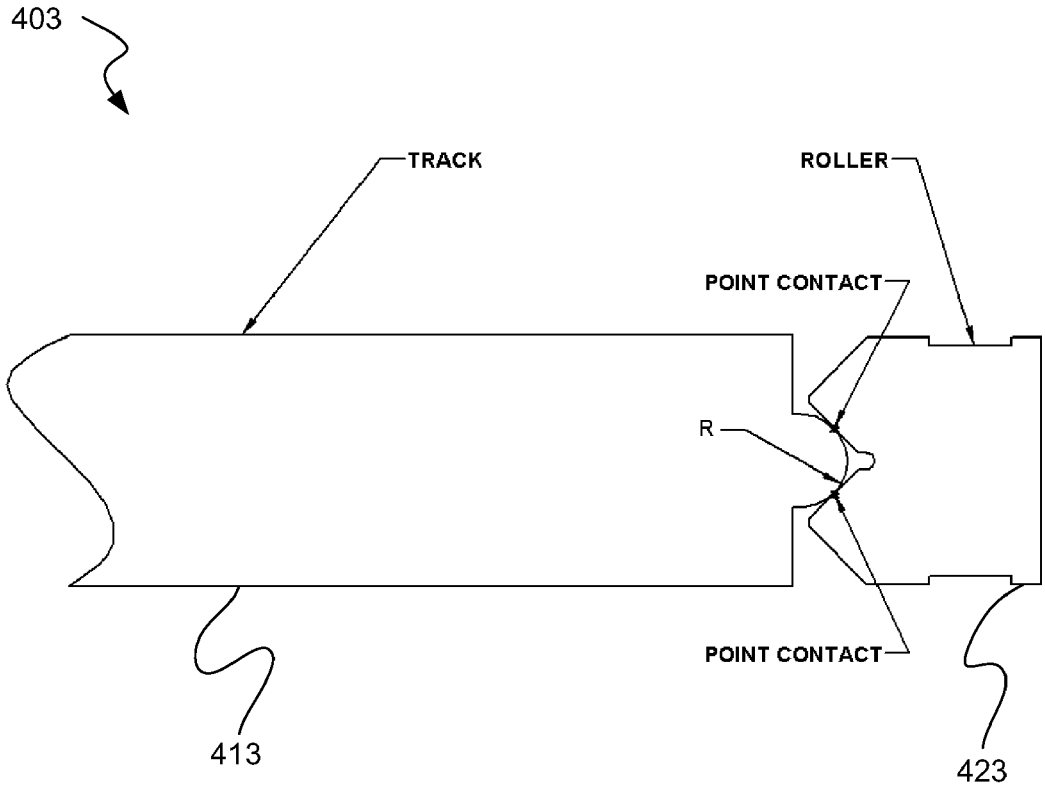
FIG. 4D is a side cut-away view of the mating between a track and a roller in a fourth possible configuration.

FIG. 4D shows a side cut-away view 403 of the mating between a track 413 and a roller 423 in a fourth possible configuration. In this configuration, a hybrid V-groove and radius interface with two points of contact between track 413 and roller 423 is provided.

Figure 4E:
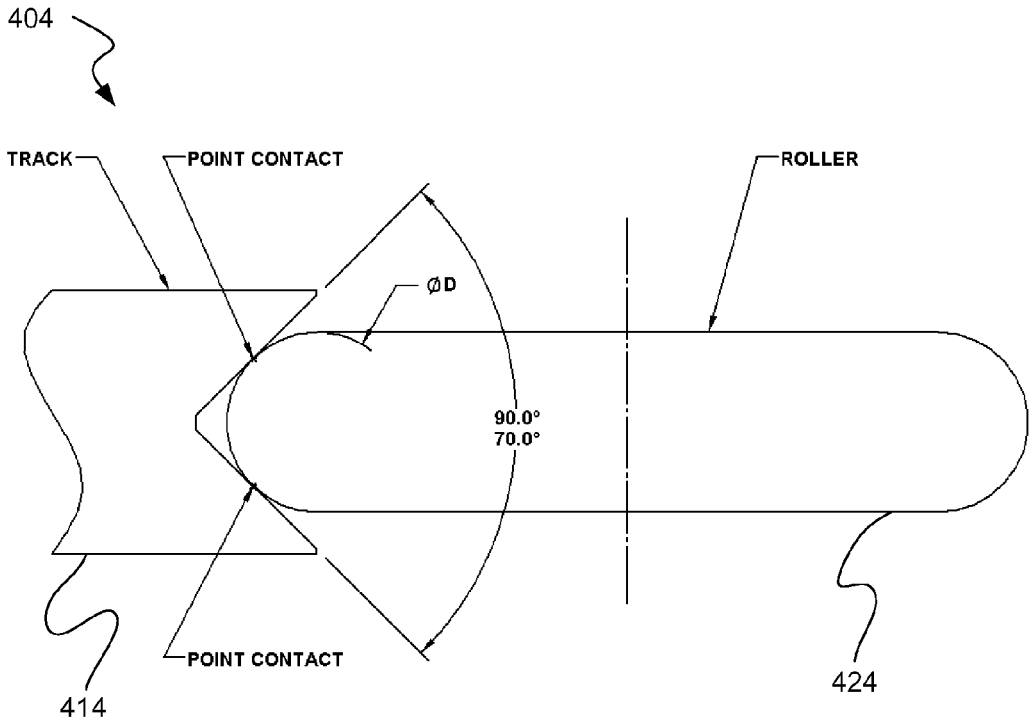
FIG. 4E is a side cut-away view of the mating between a track and a roller in a fifth possible configuration.

FIG. 4E shows a side cut-away view 404 of the mating between a track 414 and a roller 424 in a fifth possible configuration. In this configuration, another hybrid V-groove and radius interface with two points of contact between track 414 and roller 424 is provided.

Figure 5A:
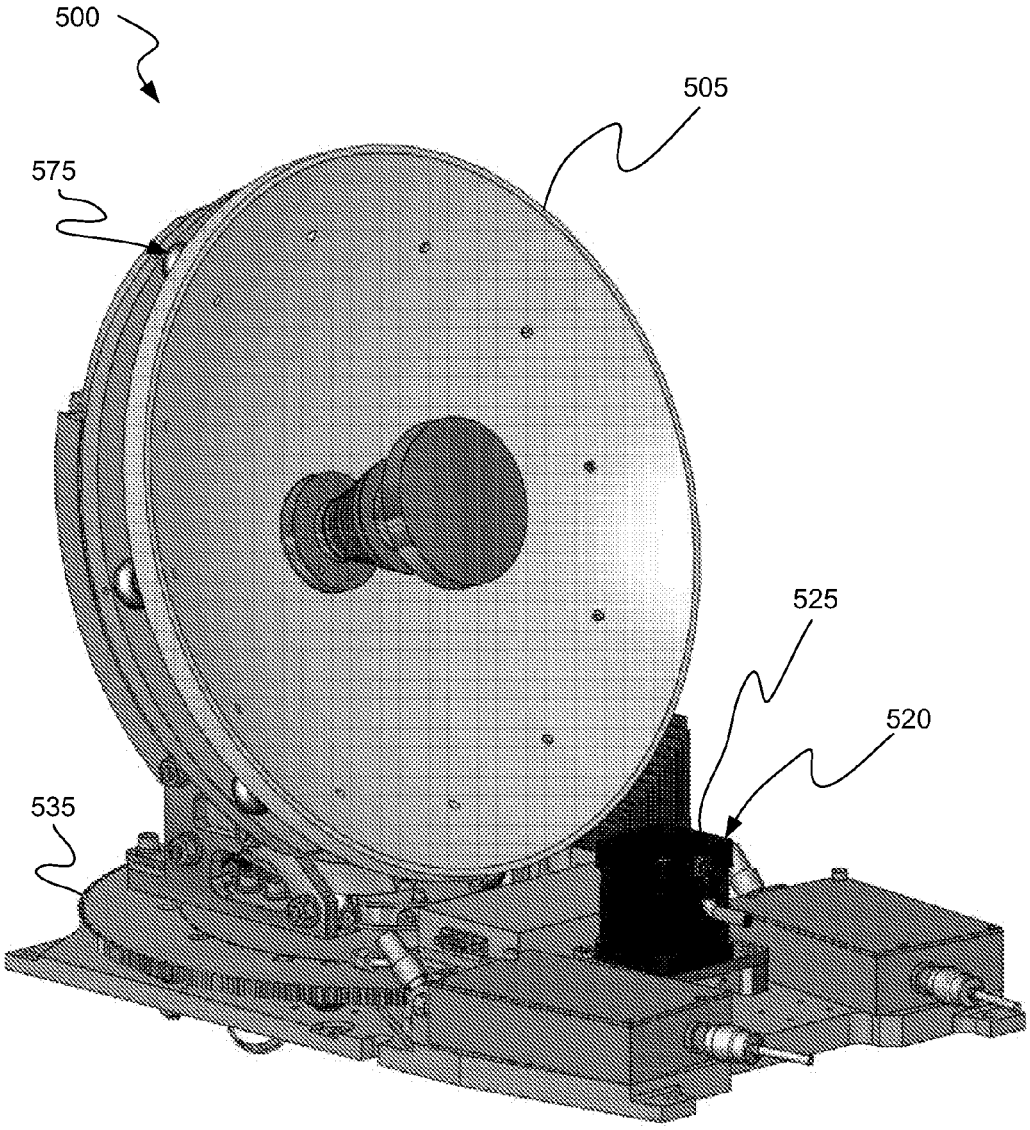
FIG. 5A is a front axonometric view of a 3-axis antenna positioner employing embodiments of the invention.
Figure 5B:
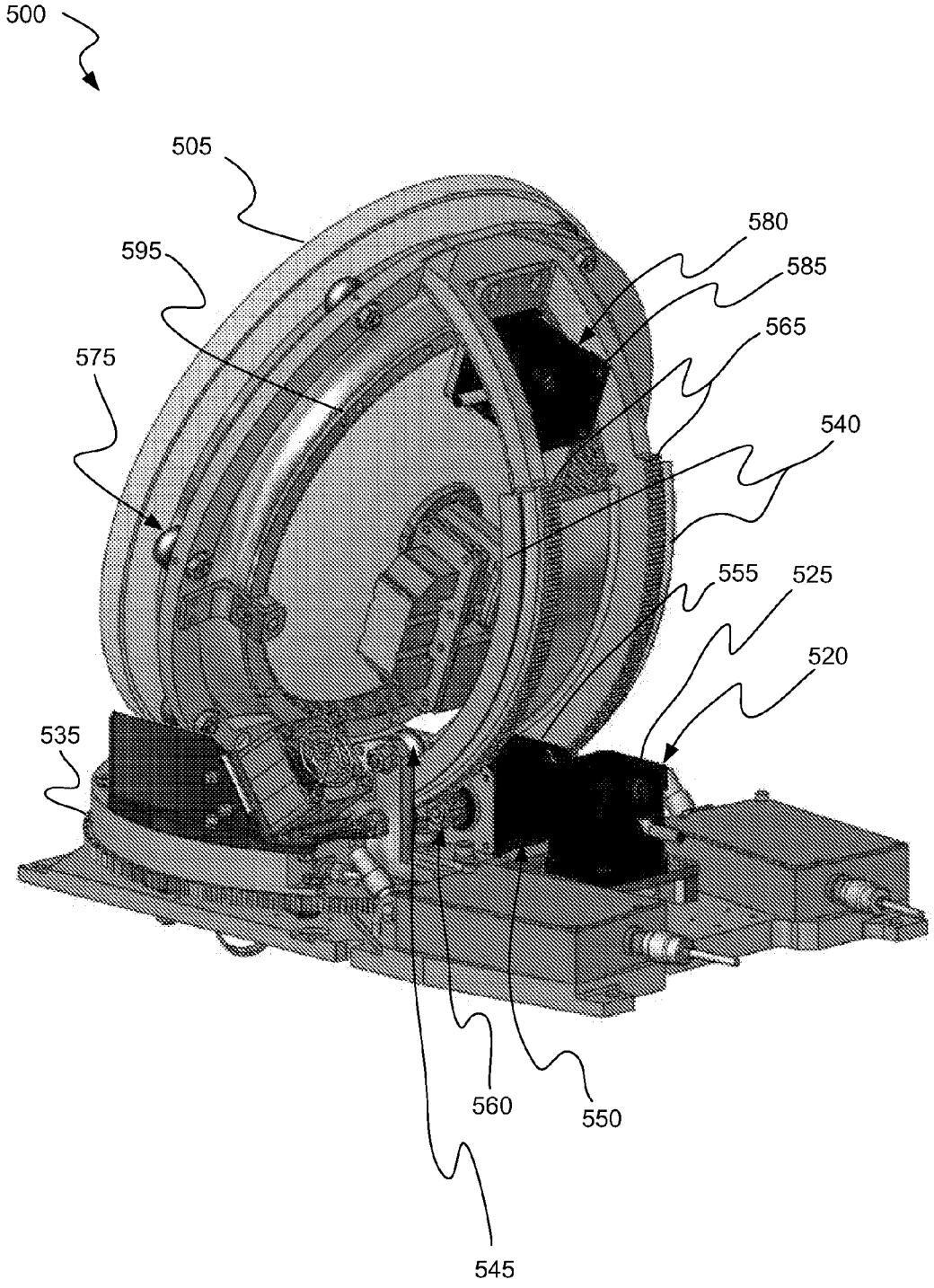
FIG. 5B is a back axonometric view of a 3-axis antenna positioner from FIG. 5A.
Figure 5C:
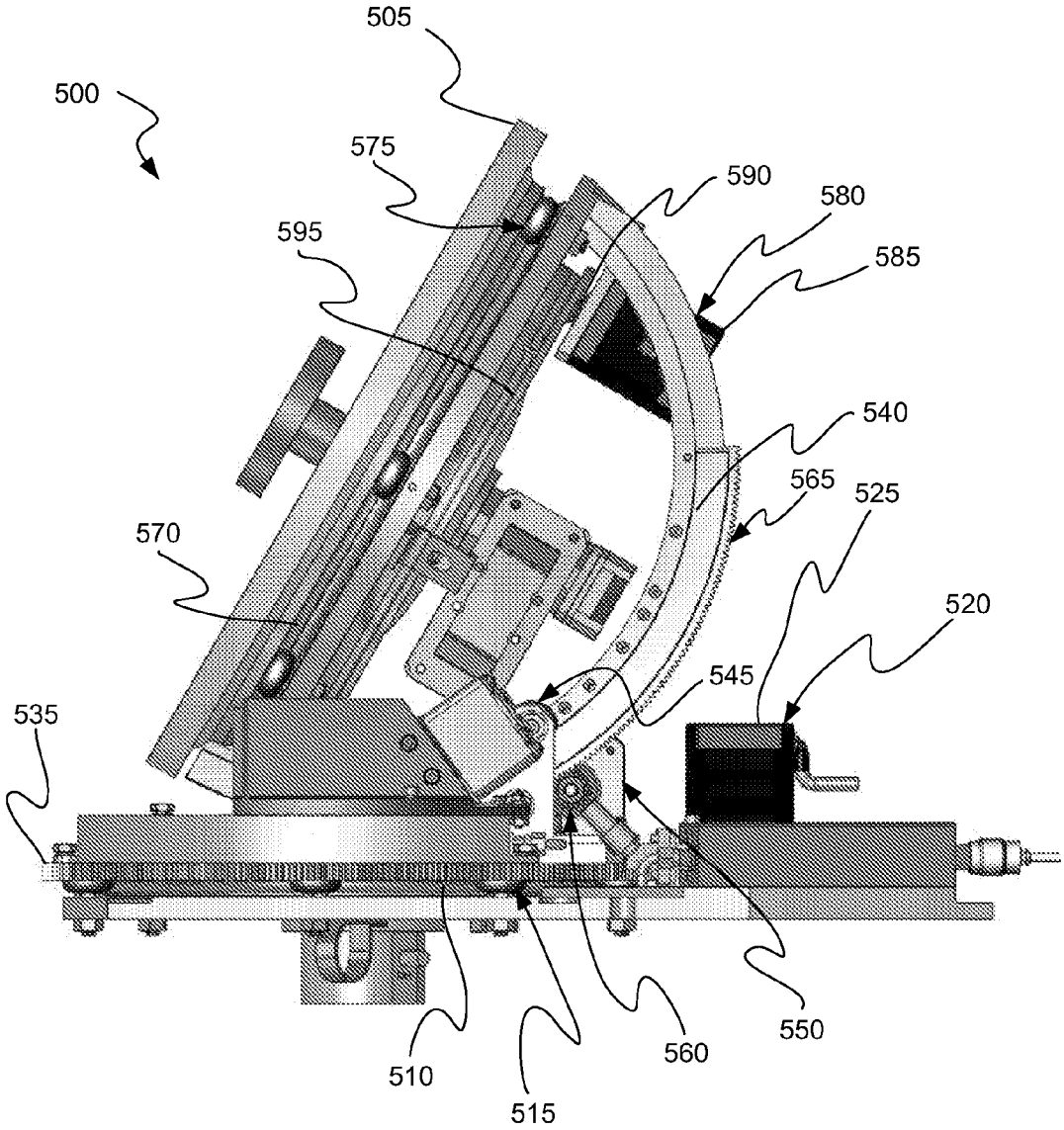
FIG. 5C is a side view of a 3-axis antenna positioner from FIGS. 5A and 5B.
Figure 5D:
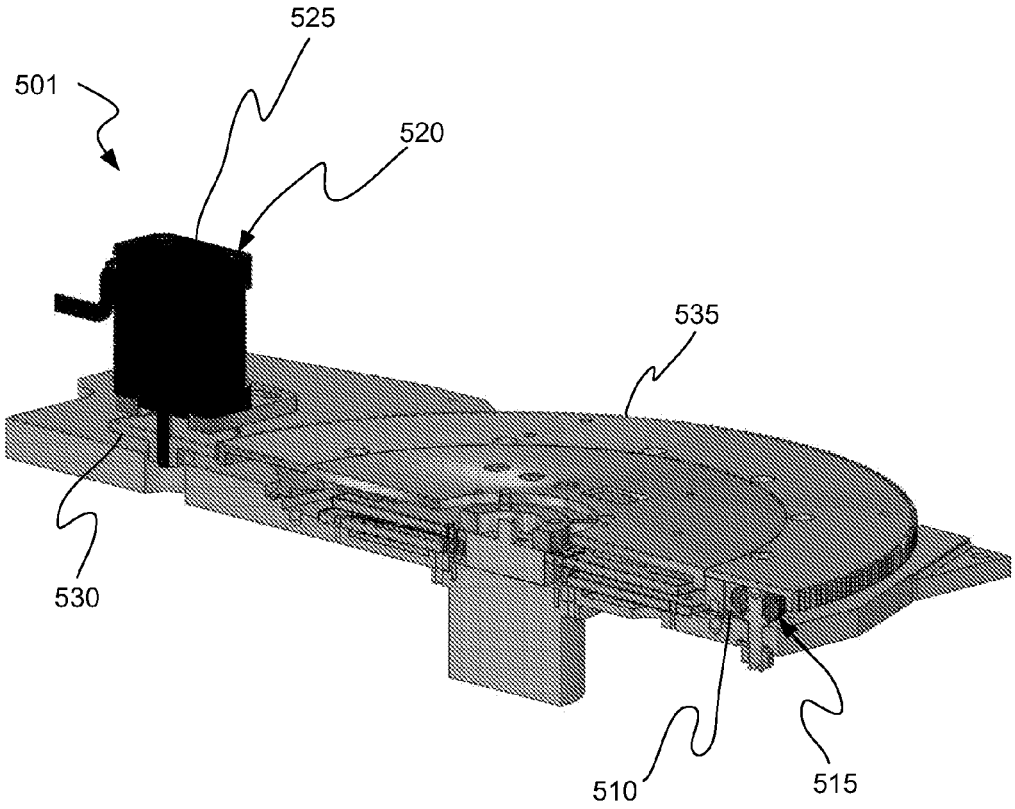
FIG. 5D is an axonometric view of both the mating between a track and a roller as well as a rotational subsystem in an azimuth axis subassembly.

FIG. 5A shows a front axonometric view of a 3-axis antenna positioner 500 employing embodiments of the invention. FIG. 5B shows a back axonometric view of a 3-axis antenna positioner from FIG. 5A after a 180 degree azimuth rotation. FIG. 5C shows a side view of a 3-axis antenna positioner from FIGS. 5A and 5B. FIG. 5D shows an axonometric view of both the mating between a track 510 and a roller 515 as well as a rotational subsystem 520 in an azimuth axis subassembly 501.

Positioner 500 includes antenna 505 and a first track 510 interfacing with a first plurality of rollers 515 to allow for azimuth rotation. A first rotational subsystem 520 provides powered rotation about the azimuth axis. First rotational subsystem 520 may include a motor and/or gearbox 525 which rotates pinion 530 to turn gear 535, which is coupled with first track 510. Consequently, azimuth rotation of antenna 505, which is coupled with first track 510, is accomplished.

Positioner 500 also includes a set of matching second tracks 540 interfacing with a second plurality of rollers 545 to allow for elevation rotation. A second rotational subsystem 550 provides powered rotation about the elevation axis. Second rotational subsystem 550 may include a motor and/or gearbox 555 which rotates pinions 560 (one pinion is hidden from view) to turn curved rack gears 565 which are coupled with second tracks 540. Consequently, elevation rotation of antenna 505, which is coupled with second track 540, is accomplished.

Positioner 500 further includes a third track 570 interfacing with a third plurality of rollers 575 to allow for polarity rotation. A third rotational subsystem 580 provides powered rotation about the polarity axis. Third rotation subsystem 580 may include a motor and/or gearbox 585 which rotates a pinion 590 to turn gear 595 which is coupled with third track 570. Consequently, polarity rotation of antenna 505, which is coupled with third track 570, is accomplished.

The invention has now been described in detail for the purposes of clarity and understanding. However, it will be appreciated that certain changes and modifications may be practiced within the scope of the appended claims.

What is claimed is:

1. A system for positioning an antenna, wherein the system comprises:

an antenna;

a first substantially circular track coupled with the antenna;

a base;

a first plurality of rollers;

a second substantially circular track coupled with the antenna;

a second plurality of rollers;

a third substantially circular track coupled with the antenna; and a third plurality of rollers, wherein:

each of the first plurality of rollers is coupled with the base;

each of the first plurality of rollers is in contact with the first substantially circular track;

each of the first plurality of rollers rotates when the first substantially circular track rotates;

each of the second plurality of rollers is coupled with the base;

each of the second plurality of rollers rotates when the second substantially circular track rotates;

each of the third plurality of rollers is coupled with the base; and each of the third plurality of rollers rotates when the third substantially circular track rotates, wherein the rotation of the third substantially circular track comprises a polarity rotation of the antenna.

2. The system for positioning an antenna of claim 1, wherein the rotation of the first substantially circular track comprises an azimuth rotation of the antenna.

3. The system for positioning an antenna of claim 1, wherein the system further comprises a rotational subsystem configured to rotate the antenna.

4. The system for positioning an antenna of claim 3, wherein the rotation subsystem comprises a gear and pinion.

5. The system for positioning an antenna of claim 3, wherein the rotation subsystem comprises a powered roller.

6. The system for positioning an antenna of claim 1, wherein the rotation of the second substantially circular track comprises an elevation rotation of the antenna.

7. The system for positioning an antenna of claim 6, wherein the system further comprises a rotational subsystem configured to rotate the antenna about an elevation axis, and wherein the rotational subsystem comprises a dual shaft motor or a dual shaft gearbox.

8. The system for positioning an antenna of claim 1, wherein:

the first substantially circular track comprises a cross-sectional perimeter, wherein at least a portion of the cross-sectional perimeter is semi-circular; and the roller comprises a cross-sectional perimeter, wherein at least a portion of the cross-sectional perimeter is semi-circular.

9. The system for positioning an antenna of claim 8, wherein the radius of the semi-circular portion of the cross-sectional perimeter of the track is greater than the radius of the semi-circular portion of the cross-sectional perimeter of the roller.

10. The system for positioning an antenna of claim 8, wherein the radius of the semi-circular portion of the cross-sectional perimeter of the track is the same as the radius of the semi-circular portion of the cross-sectional perimeter of the roller.

11. The system for positioning an antenna of claim 1, wherein:

the first substantially circular track comprises a cross-sectional perimeter, wherein at least a portion of the cross-sectional perimeter is a v-shaped groove; and the roller comprises a cross-sectional perimeter, wherein at least a portion of the cross-sectional perimeter is a v-shaped.

12. The system for positioning an antenna of claim 1, wherein:

the first substantially circular track comprises a cross-sectional perimeter, wherein at least a portion of the cross-sectional perimeter is a v-shaped groove; and the roller comprises a cross-sectional perimeter, wherein at least a portion of the cross-sectional perimeter is semi-circular.

13. A method for positioning an antenna, wherein the method comprises:

providing an antenna coupled with a first substantially circular track;

providing a first plurality of rollers;

mating the first substantially circular track with the first plurality of rollers such that a first axis of rotation is defined for the antenna; and rotating the first substantially circular track such that the antenna rotates about the first axis of rotation;

wherein the antenna is further coupled with a second substantially circular track, and the method further comprises:

providing a second plurality of rollers;

mating the second substantially circular track with the second plurality of rollers such that a second axis of rotation is defined for the antenna; and rotating the second substantially circular track such that the antenna rotates about the second axis of rotation;

and wherein the antenna is further coupled with a third substantially circular track, and the method further comprises:

providing a third plurality of rollers;

mating the third substantially circular track with the third plurality of rollers such that a third axis of rotation is defined for the antenna; and rotating the third substantially circular track such that the antenna rotates about the third axis of rotation.

14. The method for positioning an antenna of claim 13, wherein the method further comprises supporting all of the weight of the antenna with the first plurality of rollers.

15. The method for positioning an antenna of claim 13, wherein the method further comprises supporting all external loading on the antenna with the first plurality of rollers.

* * * * *